United States Patent [19]

Lutzen et al.

[11] Patent Number: 4,753,220

[45] Date of Patent: Jun. 28, 1988

[54] DIRECT CONTACT WATER HEATER

[75] Inventors: William C. Lutzen, Brookfield; Gerald A. Roszak, Brown Deer; Michael W. Valentino, Germantown, all of Wis.

[73] Assignee: Ludell Manufacturing Company, Milwaukee, Wis.

[21] Appl. No.: 11,022

[22] Filed: Feb. 5, 1987

[51] Int. Cl.[4] ..... F24H 1/10

[52] U.S. Cl. ..... 126/355; 126/359; 126/360 R; 122/20 A

[58] Field of Search ..... 126/355, 359, 361, 360 R, 126/368, 360 A; 122/20 A; 237/61

[56] References Cited

U.S. PATENT DOCUMENTS

| | | | |
|---|---|---|---|
| 884,223 | 4/1908 | Shipley | 126/355 |
| 893,084 | 7/1908 | Loomis | 126/355 |
| 1,488,958 | 4/1924 | Vosburgh | 126/359 |
| 2,651,299 | 9/1953 | Brown, Jr. | 126/85 |
| 2,759,328 | 8/1956 | Cockrell | 60/39.56 |
| 3,190,283 | 6/1965 | Miyahara | 126/35.9 |
| 3,386,436 | 6/1968 | Miyahara | 126/359 |
| 3,648,682 | 3/1972 | Bougard | 126/359 |
| 3,826,240 | 7/1974 | Miyahara | 126/359 |
| 3,994,281 | 11/1976 | Godart | 126/359 |
| 4,275,708 | 6/1981 | Wood | 126/355 |
| 4,530,347 | 7/1985 | Baker | 126/360 R |
| 4,574,775 | 3/1986 | Lutzen et al. | 126/355 |

FOREIGN PATENT DOCUMENTS

| | | | |
|---|---|---|---|
| 4513790 | 5/1970 | Japan | 126/355 |
| 582792 | 11/1946 | United Kingdom | 126/355 |

*Primary Examiner*—James C. Young
*Attorney, Agent, or Firm*—Fred Wiviott

[57] ABSTRACT

A direct contact water heater comprises a cylindrical column having a plurality of heat exchange bodies disposed in the upper portion thereof, a spray nozzle disposed above the heat exchange bodies for discharging water thereon and a combustion chamber extending into the lower end of the column. A cooling jacket is mounted in surrounding relation to the combustion chamber and extends downwardly along the sides and around the bottom thereof. The cooling jacket is open at its upper end for receiving a portion of the water falling from the heat exchange bodies and has a discharge opening formed adjacent its upper periphery for discharging a portion of the collected water into a water tank below the column to effect circulation of the cooling water through the jacket.

13 Claims, 2 Drawing Sheets

DIRECT CONTACT WATER HEATER

BACKGROUND OF THE INVENTION

This invention relates to water heaters and more particularly to direct contact water heaters.

Direct contact water heaters, such as that disclosed in U.S. Pat. No. 4,574,775 comprise, a vertically oriented cylindrical column having a plurality of heat exchange bodies disposed adjacent its upper end and a spray nozzle located above the heat exchange bodies for spraying water to be heated downwardly thereon. A combustion chamber for containing a burner extends through an opening in the column and below the heat exchange bodies for injecting heated combustion products inwardly into the column. The hot gases pass upwardly through the heat exchange bodies located in the upper end of the column and are then exhausted. The water discharged from the nozzle flows downwardly over the heat exchange bodies and through the heated combustion products.

In one type of prior art direct contact water heater, a water jacket is disposed within the column and surrounds at least that portion of the column which defines the combustion chamber. A portion of the feed water is delivered to the lower end of the water jacket from where it flows upwardly between the water jacket and the column and discharges from the upper end of the water jacket to be mixed with the water delivered from the spray nozzle.

SUMMARY OF THE INVENTION

It is an object of the invention to provide a new and improved direct contact water heater.

A further object of the invention is to provide a direct contact water heater which does not require a complete water jacket in surrounding relation to the housing.

Another object of the invention is to provide a direct contact water heater which is simpler and less expensive to fabricate than prior art heaters.

These and other objects and advantages of the present invention will become more apparent from the detailed description thereof taken with the accompanying drawings.

In general terms, the invention comprises a direct contact water heater which includes a column having a plurality of heat exchange bodies disposed in the upper end thereof, spraying means disposed above the heat exchange bodies for spraying water downwardly thereon and combustion means extending into the lower end of the column for delivering heated gases thereto. A combustion chamber extends into the column and has an upper surface lying in the path of the water descending from the heat exchange bodies. The improvement comprises a water jacket extending around the combustion chamber and having an upper periphery extending above the surface upper combustion chamber surface, the water jacket being open at its upper end, and a recess formed adjacent the upper end of the water jacket and at one end thereof for discharging water from the jacket downwardly into the lower end of the column.

DETAILED DESCRIPTION OF THE PREFERRED EMBODIMENTS

Figures 1, 3:
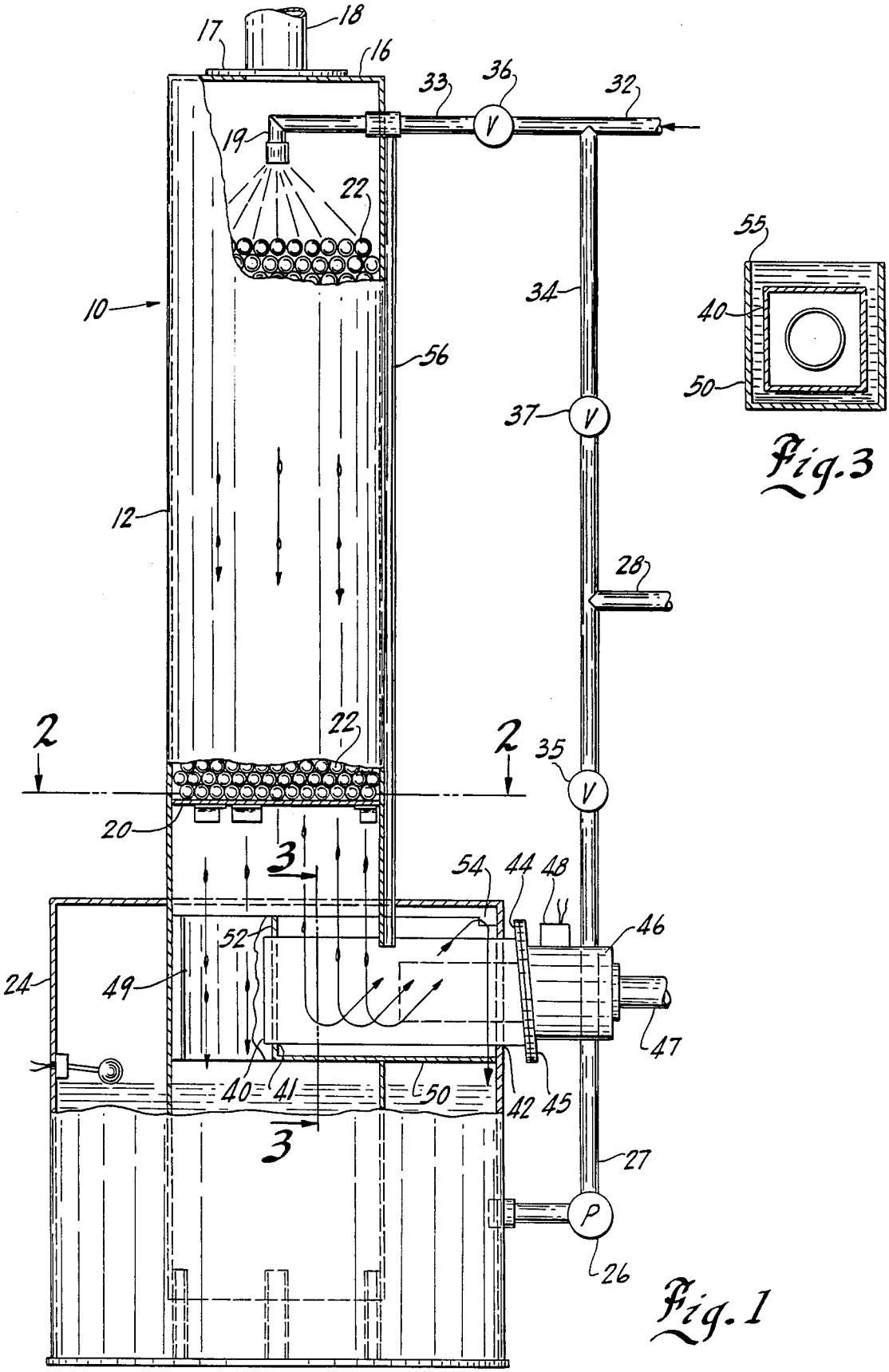
FIG. 1 is a side elevational view, partly in section, of a direct contact water heater which incorporates a preferred embodiment of the invention.
FIG. 3 is a view taken along lines 3—3 of FIG. 1.

The direct contact water heater 10 in accordance with the preferred embodiment of the invention is shown in FIG. 1 to include a vertically oriented tubular column 12 formed of any suitable metallic material, such as steel. While the column 12 is shown to be cylindrical, it may have any convenient shape. The lower end of the column 12 is open while the upper end has a flange 16 to which the bottom flange 17 of the flue 18 may be secured. Alternately, an apertured cover (not shown) may be provided for receiving the flue 18.

A spray nozzle 19 is disposed in column 12 adjacent its upper end and is connected to a source of water, as will be discussed more fully below. Extending horizontally across the column 12 and spaced above its lower end is a support screen 20 which supports a plurality of heat exchange bodies 22. The screen 20 is fixed to the inner surface of column 12 in any suitable manner. As those skilled in the art will appreciate, the heat exchange bodies 22 generally comprise hollow spherical, tubular or egg shaped metallic members having perforations or slots for providing a medium by which in the combustion products passing upwardly therethrough is transferred to water flowing in the opposite direction primarily by direct contact. Since the heat exchange bodies 22 are conventional and well known in the art, they will not be discussed in detail for the sake of brevity.

In the preferred embodiment, the lower end of the column 12 is shown to be suitably located in and supported above the lower wall of a water storage tank 24. The open lower end of column 12 communicates with the tank although it will be appreciated that column 12 may also be connected by piping to a free standing water tank. In the latter configuration, the lower end of the column in closed.

A suitable pump 26 has its inlet connected to the tank 24 and its outlet to a pipe 27 for delivering heated water to outlet pipes 27 and 28. In addition, a cold water inlet pipe 32 is connected to the nozzle 19 and a recirculation pipe 34 interconnects pipes 28 and 32. Suitable shut-off valves 35, 36 and 37 are disposed in pipes 27, 32 and 34, respectively.

A metallic, generally tubular, open ended combustion chamber 40 extends through and is suitably fixed in aligned openings 41 and 42 formed in the column 12 and the water tank 24, respectively. This positions the combustion chamber 4D with one end located within the column 12 and its opposite end extending beyond the surface of the water tank 24. A flange 44 is suitably affixed to the outer end of the combustion chamber 40 for receiving a mating flange 45 on a burner 46. The flange 45 and burner 46 close the open outer end of the combustion chamber 40. The burner 46 is connected by a conduit 47 to a source of a gaseous or liquid fuel and to a source of combustion air (not showing). In addition, the burner 46 may be provided with an electric starting device 48. A partial water jacket 49 may be disposed opposite the burner 46.

A cooling water jacket 50 which is generally rectangular in vertical cross-section, is disposed partially within the water tank 24 and partially within the column 12 and extends downwardly along the sides and around the bottom of the combustion chamber 40. One end of the cooling water jacket 50 is closed by an end closure 52 which extends between the sides of the combustion chamber 40 and the inner surface of the water jacket 50. The other end of the water jacket 50 is closed by the inner surface of the water tank 24. A pair of notches 54 are cut in the upper edges 55 of the water jacket 50 and in its end adjacent the wall of the water tank 24. A bleed pipe 56 extends downwardly from the water inlet pipe 33 and along the surface of the column 12 and terminates the water jacket 50 at a point below its upper edge 55.

In operation of the water heater 10, cold water is initially discharged downwardly from the nozzle 19 onto the heat exchange bodies 22 within the column 12. This water flows downwardly through the heat exchange bodies 22 and the screen 20 upon which they are supported. In the meantime, a suitable fuel and air mixture is provided to the burner 46 to produce a flame within the combustion chamber 40. The heated combustion products are discharged from the open inner end of the combustion chamber and flow upwardly through the heat exchange bodies 22 in counter-current to the water flowing downwardly. The heated gases release heat to the water primarily by direct contact which is facilitated by the bodies 22. This heated water collects in the tank 24 from which it is delivered by pump 26 to the outlet pipe 28.

A portion of the water flowing downwardly through the column 12 will fall into that portion of the open upper end of the water jacket 50 which is located within column 12. This water will circulate around the combustion chamber 40 and overflow at the notches 54 to fall into the storage tank 24. The circulation of cooling water around the combustion chamber 40 is enhanced by additional cooling water which flows downwardly through the bleed pipe 56 and into the water jacket 50. As those skilled in the art will appreciate, the valve 36 in delivery pipe 33 will be responsive to a lever actuated device 58 for maintaining the water within the tank 24 below the lever of the combustion chamber 40.

Figure 2:
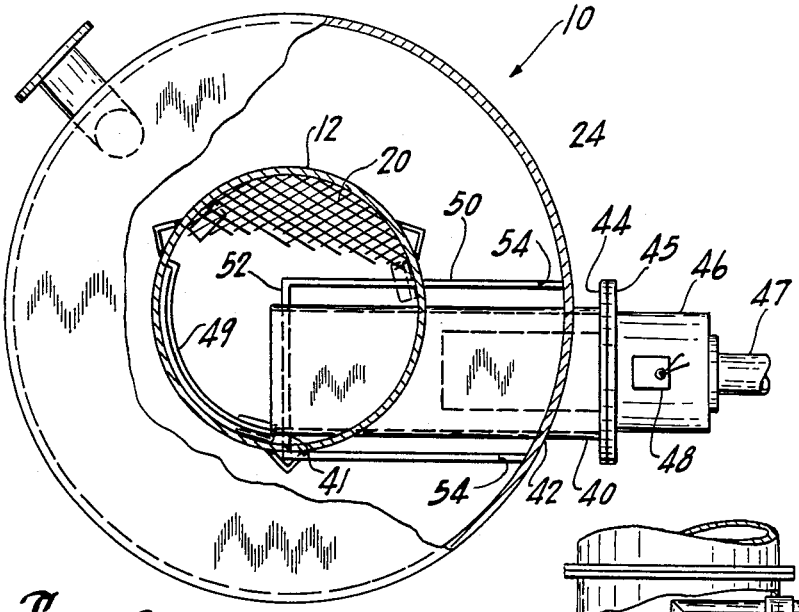
FIG. 2 is a view taken along lines 2—2 of FIG. 1.
Figure 4:
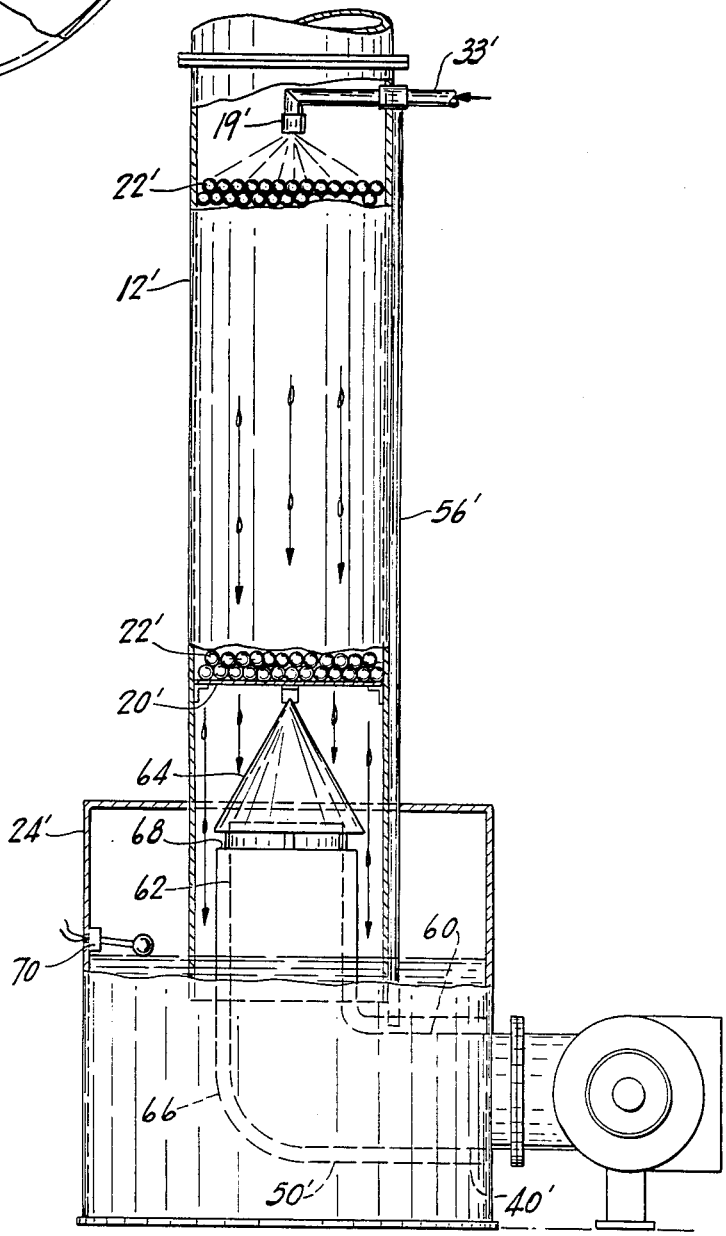
FIG. 4 shows an alternate embodiment of the invention.

An alternate embodiment of the invention is shown in FIG. 3. Corresponding parts in the alternate embodiment have been given the same reference numerals as the embodiment FIGS. 1 and 2 except that they are distinguised by a prime (′). In this embodiment, the combustion chamber 40′ is generally L shaped with one portion 60 extending horizontally into the water tank 24′ below the lower end of the column 12′. A second part 62 of combustion chamber 40 extends at an angle of 90 degrees from the inner end of the first part 60, upwardly through the lower end of the column 12′ and along its axis to a point below the screen 20′. A conical shield 64 is suitably affixed above the open upper end of the combustion chamber portion 62 and is spaced therefrom to permit the exit of combustion products. A cooling water jacket 50′ is spaced from and surrounds the horizontally extended portion 60 of combustion chamber 40′. An elbow section 66 is provided around the inner end of the combustion chamber 40′ and has an upwardly facing open end portion 68.

A suitable water level sensing device 70 maintains the water level within the tank 24′ at a point below the open end 68 of the cooling jacket 50′ and the open upper end of the combustion chamber portion 62. This will permit water within the tank 24′ to flow through the cooling jacket's open end 68 and into the space between the combustion chamber 40′ and the cooling jacket 50′. Circulation of water in the gap in this space is enhanced by a bleed pipe 56′ which extends from the inlet pipe 33′.

While only two embodiments of the invention have been illustrated and described, it is not intended to be limited thereby but only by the scope of the appended claims.

I claim:

1. A direct contact water heater having a vertically oriented column, a plurality of heat exchange bodies disposed in the upper portion of said column, a spraying device disposed above the heat exchange bodies for discharging water to be heated downwardly thereon, a combustion chamber extending into said column for receiving heated combustion products, said combustion chamber being open at its inner end whereby heated gases therefrom will flow upwardly through the heat exchange bodies for transferring heat thereto, a cooling water jacket extending downwardly along the sides of and around the bottom of the combustion chambers said jacket being open at its upper end for receiving cooling water falling from said spray nozzle so that water collects around said combustion chamber for cooling the same, tank means disposed adjacent the lower end of said column and communicating therewith for collecting heated water flowing downwardly in said column, and means for maintaining the level of the water in said column and tank means below the combustion chamber so that the combustion chamber is above the level of water in said column and tank means, excess cooling water in said cooling jacket flowing through said an upper end and downwardly into said tank means.

2. The direct contact water heater set forth in claim 17 and including pipe means for delivering cooling water to the cooling water jacket in addition to the water received in the open upper end thereof.

3. A direct contact water heater having a vertically oriented column, a plurality of heat exchange bodies disposed in the upper portion of said column, a spraying device dipsosed above the heat exchange bodies for discharging water to be heated downwardly thereon, a combustion chamber extending into said column for receiving heated combustion products, said combustion chamber being open at its inner end whereby heated gases therefrom will flow upwardly through the heat exchange bodies for transferring heat thereto, a cooling water jacket disposed around the combustion chamber and being open at its upper end for receiving cooling water falling from said spray nozzle, said water circulating around said combustion chamber for cooling the same, pipe means for delivering cooling water to the cooling water jacket in addition to the water received in the open upper end thereof, said cooling water jacket being generally U-shaped in horizontal cross section and extending downwardly along the sides of and around the bottom of the combustion chamber, and at least one recess formed in the upper edge of the open upper end of the cooling jacket for discharging water therefrom.

4. The direct contact water heater set forth in claim 3 wherein there are a pair of recesses formed in the upper edge of the cooling jacket and adjacent the outer end thereof.

5. The direct contact water heater set forth in claim 4 and including a water tank at the lower end of said column and arranged in concentric surrounding relation thereto, the cooling jacket and combustion chamber extending through said water tank and into said column, said recesses being in the portion of said water jacket within said water tank.

6. A direct contact water heater having a vertically oriented column, a plurality of heat exchange bodies disposed in the upper portion of said column, a spraying device disposed above the heat exchange bodies for discharging water to be heated downwardly thereon, a combustion chamber extending into said column for receiving heated combustion products, said combustion chamber being open at its inner end whereby heated gases therefrom will flow upwardly through the heat exchange bodies for transferring heat thereto, a cooling water jacket disposed around the combustion chamber and being open at its upper end for receiving cooling water falling from said spray nozzle, said water circulating around said combustion chamber for cooling the same, a water tank disposed in surrounding relation to the lower end of said column, said combustion chamber being generally L shaped and having a first portion extending horizontally through said water tank and a vertically oriented second portion extending upwardly through the lower end of the column and along the axis thereof, said second portion being open at its upper end, shield means disposed over the open upper end of the combustion chamber to permit combustion gases to escape therefrom, said shield preventing water flowing downwardly from said heat exchange bodies from entering said combustion chamber, said cooling water jacket surrounding the first and second portions of said combustion chamber and having an upper end which is open and spaced below the open upper surrounding end of the second.

7. The direct contact water heater set forth in claim 6 and including pipe means for delivering cooling water to the cooling jacket in addition to the water received in the open end thereof, said pipe means extending to a point in said jacket below the combustion chamber.

8. The direct contact water heater set forth in claim 7 and including a water level controller within the water tank to maintain the level of water therein below the open upper end of the combustion chamber and above the open upper end of the cooling water jacket.

9. A direct contact water heater having a vertically oriented housing, a plurality of heat exchange bodies disposed in the upper portion of said housing, a spraying device disposed above the heat exchange bodies for discharging water to be heated downwardly thereon, a combustion chamber extending horizontally into said housing for receiving heated combustion products, said combustion chamber being open at its inner end whereby heated gases therefrom will flow upwardly through the heat exchange bodies for transferring heat thereto, a cooling water jacket spaced from and extending downwardly along the sides and around the bottom of the combustion chamber, said cooling water jacket being open at its upper end for receiving cooling water falling from said spray nozzle so that water will circulate around said combustion chamber for cooling the saem, tank means communicating with the lower end of said housing for receiving the heated water flowing downwardly in said housing, and means for maintaining the level of water in said tank means below the level of said combustion chamber.

10. The direct contact water heaters set forth in claim 9 and including pipe means for delivering cooling water to the cooling water jacket in addition to the water received in the open upper end thereof.

11. The direct contact water heater set forth in claim 10 and including a water tank at the lower end of said housing and arranged in surrounding relation thereto, the cooling jacket and combustion chamber extending through said water tank and into said column.

12. A direct contact water heater having a vertically oriented housing, a plurality of heat exchange bodies disposed in the upper portion of said housing, a spraying device disposed above the heat exchange bodies for discharging water to be heated downwardly thereon, a combustion chamber extending horizontally into said housing for receving heated combustion products, said combustion chamber being open at its inner end whereby heated gases therefrom will flow upwardly through the heat exchange bodies for transferring heat thereto, a cooling water jacket spaced from the sides and bottom of the combustion chamber and having an opening in an upper portion thereof for receiving cooling water falling from said spraying device, said water circulating around said combustion chamber for cooling the same, pipe means for delivering cooling water to the cooling water jacket in addition to the water received in the open upper end thereof, a water tank at the lower end of said housing and arranged in surrounding relation thereto, the cooling jacket and combustion chamber extending through said water tank and into said column, said cooling jacket having a first end disposed within the housing and a second end within the water tank and outside of the housing, and water discharge means on the end of said cooling jacket within said water tank to promote water circulation from said first end.

13. The direct contact water heater set forth in claim 12 wherein said cooling jacket extends downwardly along the sides of and around the bottom of the combustion chamber, said jacket being opened at its upper end, said water discharge means including at least one recess formed in the upper edge of the open upper end of the cooling jacket for discharging water therefrom.

* * * * *